US007775147B2

(12) United States Patent
Crawford et al.

(10) Patent No.: US 7,775,147 B2
(45) Date of Patent: Aug. 17, 2010

(54) DUAL REDUNDANT ELECTRO EXPLOSIVE DEVICE LATCH MECHANISM

(75) Inventors: Daniel M. Crawford, Tucson, AZ (US); Bruce E. Morgan, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 325 days.

(21) Appl. No.: 12/077,157

(22) Filed: Mar. 17, 2008

(65) Prior Publication Data

US 2010/0175546 A1 Jul. 15, 2010

(51) Int. Cl.
*B64D 1/04* (2006.01)

(52) U.S. Cl. ..... 89/1.14; 244/134 F; 244/129.1; 244/113; 244/110 D; 244/99.12; 114/336; 114/20.1

(58) Field of Classification Search ..... 89/1.14; 244/134 F, 131, 129.1, 113, 110 D, 99.12; 114/336, 20.1
See application file for complete search history.

(56) References Cited

U.S. PATENT DOCUMENTS 4,264,115 A 4/1981 Chow
4,738,421 A 4/1988 Green et al.
7,127,994 B2 * 10/2006 Cleveland ..... 102/378
7,188,558 B2 * 3/2007 Brede et al. ..... 89/1.14
7,261,038 B2 * 8/2007 Cleveland ..... 102/378
7,327,232 B2 2/2008 Nowak et al.
7,513,184 B2 * 4/2009 Kister ..... 89/1.57
2004/0226474 A1 * 11/2004 Comtesse ..... 102/378

OTHER PUBLICATIONS

International Application Serial No. PCT/US2009/000199, Search Report mailed Mar. 9, 2009.
International Application Serial No. PCT/US2009/000199, Written Opinion mailed Mar. 9, 2009.

* cited by examiner

*Primary Examiner*—J. Woodrow Eldred
(74) *Attorney, Agent, or Firm*—Schwegman, Lundberg & Woessner, P.A.; Gregory J. Gorrie

(57) ABSTRACT

A latch including a first electrical explosive device disposed between first and second surfaces and a second electrical explosive device disposed between said first and second surfaces in series with said first electrical explosive device. In the illustrative embodiment, the vehicle is a missile or torpedo, the first surface is a drag door and the second surface is a vehicle body. In this embodiment, the first electrical explosive device is coupled to the vehicle body on a first end of the device and to a common series attachment on another end thereof and the second electrical explosive device is connected to the common series attachment on a first end and to the drag door on a second end thereof. An arrangement is included for activating the electrical explosive devices to effect a deployment of the drag door with a high degree of reliability.

25 Claims, 6 Drawing Sheets

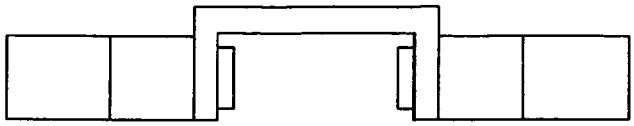
FIG. 4e
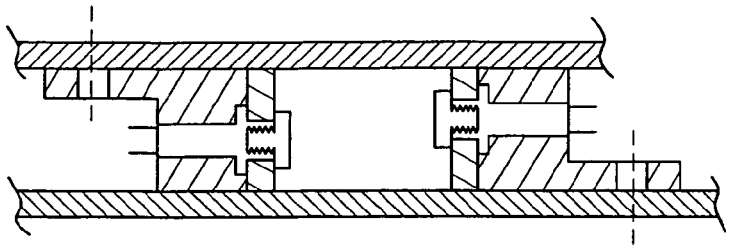
FIG. 4f
FIG. 4g
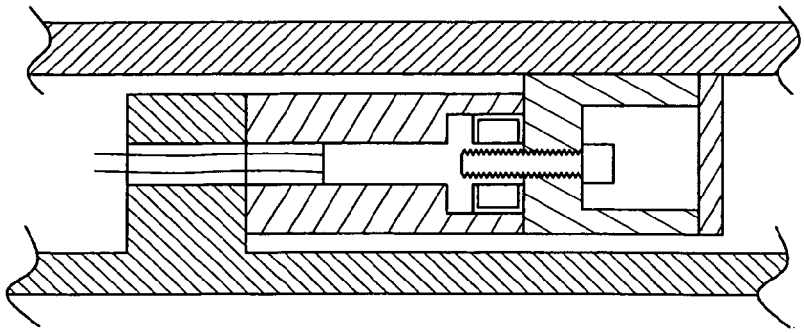
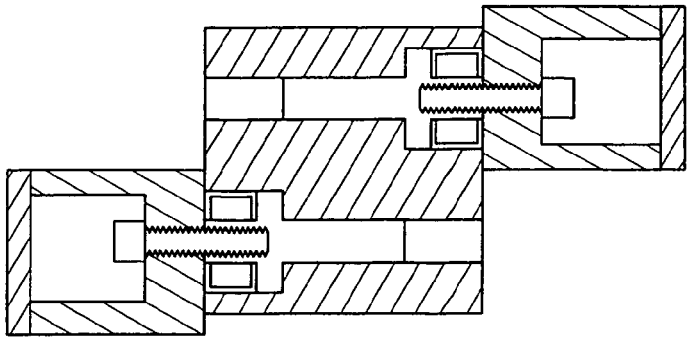
FIG. 4h

FIG. 6
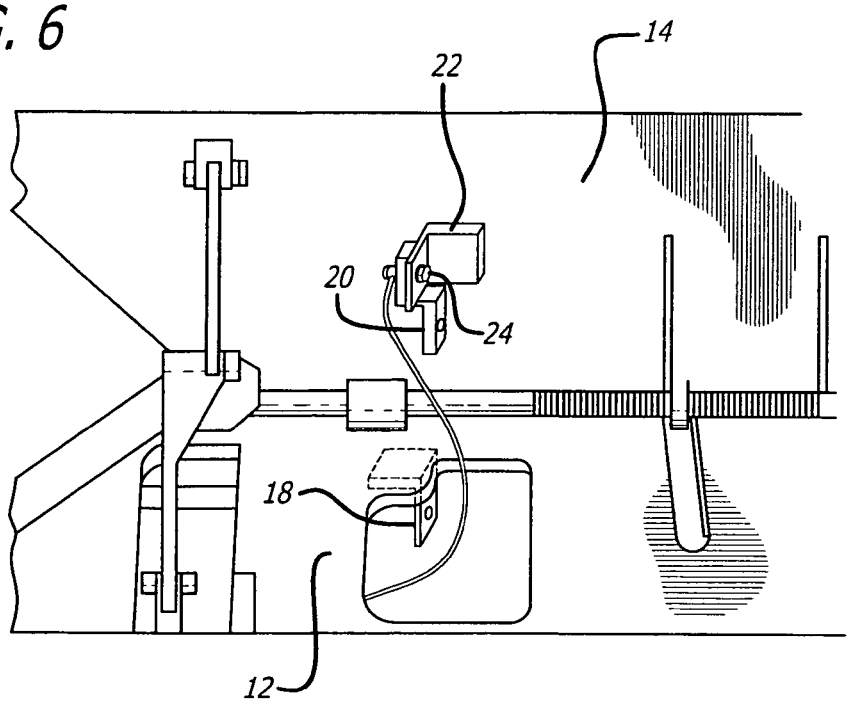
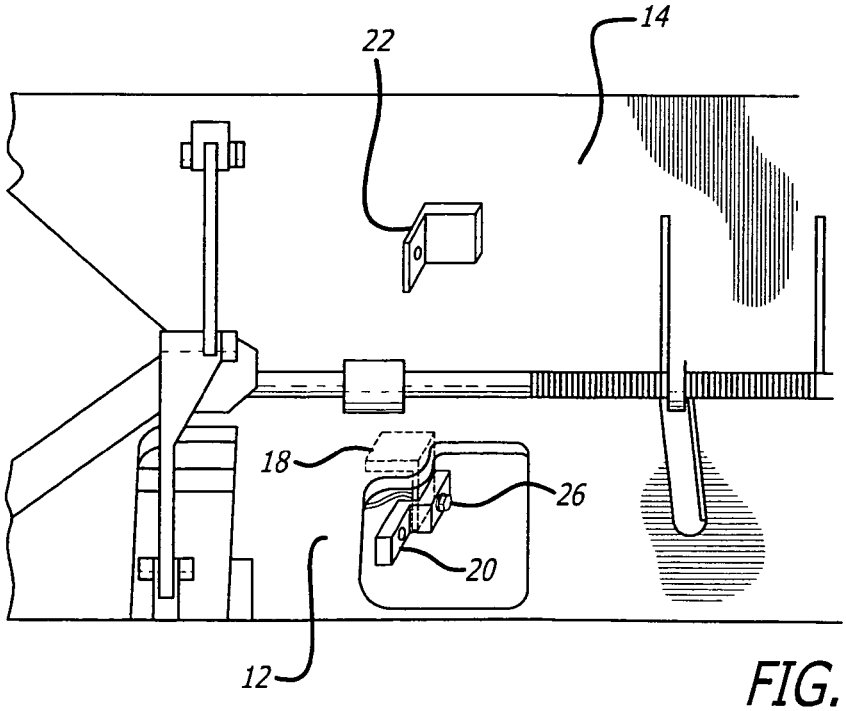
FIG. 7

DUAL REDUNDANT ELECTRO EXPLOSIVE DEVICE LATCH MECHANISM

BACKGROUND OF THE INVENTION

1. Field of the Invention

The present invention relates to avionics and hydraulics. More specifically, the present invention relates to systems and methods for inducing drag in missiles, torpedoes and other guided projectiles.

2. Description of the Related Art

It is often desirable to provide a fail-safe method for testing a missile or other vehicle on a range. Several methods have been employed to ensure fail-safe testing of a missile. One such method involves the use of explosives to detonate the missile. However, this approach is problematic inasmuch as it is risky and problematic to store explosives. In addition, the detonation of the missile can cause unacceptable collateral damage inasmuch as when a missile is detonated, it breaks into many pieces that result in a large debris field on the ground.

Another approach involves the use of hard over control surfaces. When activated, these surfaces steer the vehicle into the ground or other safe location. Unfortunately, the system for controlling the hard over control surfaces is typically the same system used to guide the missile. Failure of the guidance system can therefore also lead to a failure of a fail-safe system using this approach. Hence, for certain tests, an independent means of terminating a flight is preferred.

A third approach involves the use of drag doors. Drag doors are planar surfaces which are spring-loaded and attached to a missile body on one end and latched in a closed position on an opposite end thereof. When the latch is released, the door is deployed to an open position at which causes the vehicle to become unstable and crash within a predictable area on the ground. In this approach, the vehicle remains intact until impact with the ground. It is critical that the latch successfully actuates and releases the drag door.

Prior approaches for ensuring successful operation have included the use of electromagnets and solenoids. Electromagnets require electric power to hold the door in the closed position. Electromagnetics and solenoids are often too bulky and complex. The weight can adversely affect the performance of the missile and the complexity can limit reliability.

Hence, a need remains in the art for an improved system or method for effecting a latching of the drag door in a reliable manner.

SUMMARY OF THE INVENTION

The need in the art is addressed by the latch of the present invention. The inventive latch includes a first electrical explosive device disposed between first and second surfaces and a second electrical explosive device disposed between said first and second surfaces in series with said first electrical explosive device.

In the illustrative embodiment, the vehicle is a missile or torpedo, the first surface is a drag door and the second surface is a vehicle body. In this embodiment, the first electrical explosive device is coupled to the vehicle body on a first end of the device and to a common series attachment on another end thereof and the second electrical explosive device is connected to the common series attachment on a first end and to the drag door on a second end thereof. An arrangement is included for activating the electrical explosive devices to effect a deployment of the drag door with a high degree of reliability.

BRIEF DESCRIPTION OF THE DRAWINGS

FIG. 6 is a front view of an illustrative implementation of a fully deployed drag door after a mis-firing of one of the EEDs such that the second bracket 20 remains with the drag door 14.

FIG. 7 is a front view of an illustrative implementation of a fully deployed drag door after a mis-firing of one of the EEDs such that the second bracket 20 remains with the missile body 12.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1C:
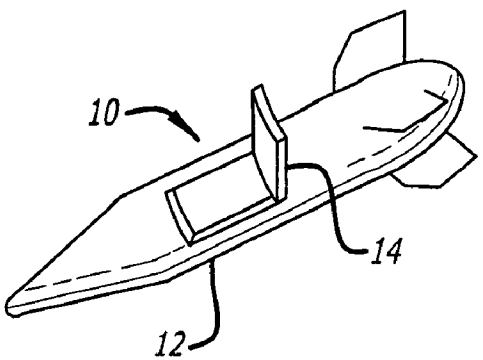
FIG. 1*c* is a simplified perspective view of the missile of FIG. 1*a* with the drag door in a fully deployed position.
Figure 1B:
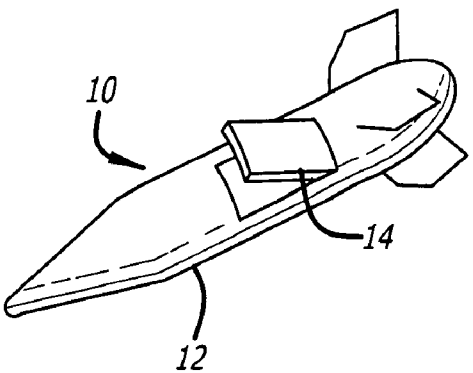
FIG. 1*b* is a simplified perspective view of the missile of FIG. 1*a* with the drag door in a partially deployed position.
Figure 1A:
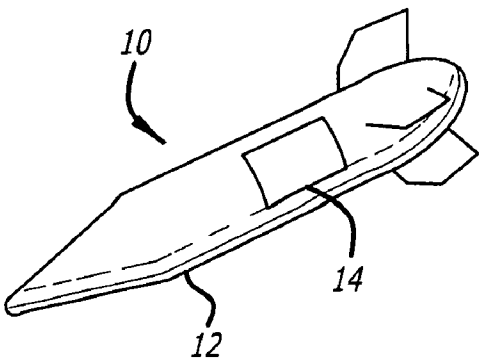
FIG. 1*a* is a simplified perspective view of a missile with a drag door in a stowed position in accordance with an illustrative embodiment of the present teachings.

In the illustrative application, the invention is part of a missile flight termination system. However, the invention is not limited thereto. The invention may be used in other vehicles, e.g. torpedoes, without departing from the scope of the present teachings. The flight termination system includes a destabilization (drag) door that is flush to the missile body when closed. This is illustrated in FIGS. 1*a-c* below. In the event that a test flight must be terminated, the door is deployed to cause the missile to crash within a prescribed area on the ground relative to the missile position at initiation of the flight termination sequence. The present invention provides a compact means of retaining the drag door closed while providing a compact yet reliable (dual redundant) arrangement for deploying the door.

FIG. 1*a* is a simplified perspective view of a missile 10 with a drag door 14 in a stowed position on the missile body 12 in accordance with an illustrative embodiment of the present teachings. In accordance with the present teachings, the door 14 is retained in the stowed position by a latch 16 (not shown in FIG. 1*a*). An illustrative implementation of the latch 16 is shown in FIG. 2.

FIG. 1*b* is a simplified perspective view of the missile of FIG. 1*a* with the drag door in a partially deployed position.

FIG. 1*c* is a simplified perspective view of the missile of FIG. 1*a* with the drag door in a fully deployed position.

Figure 2:
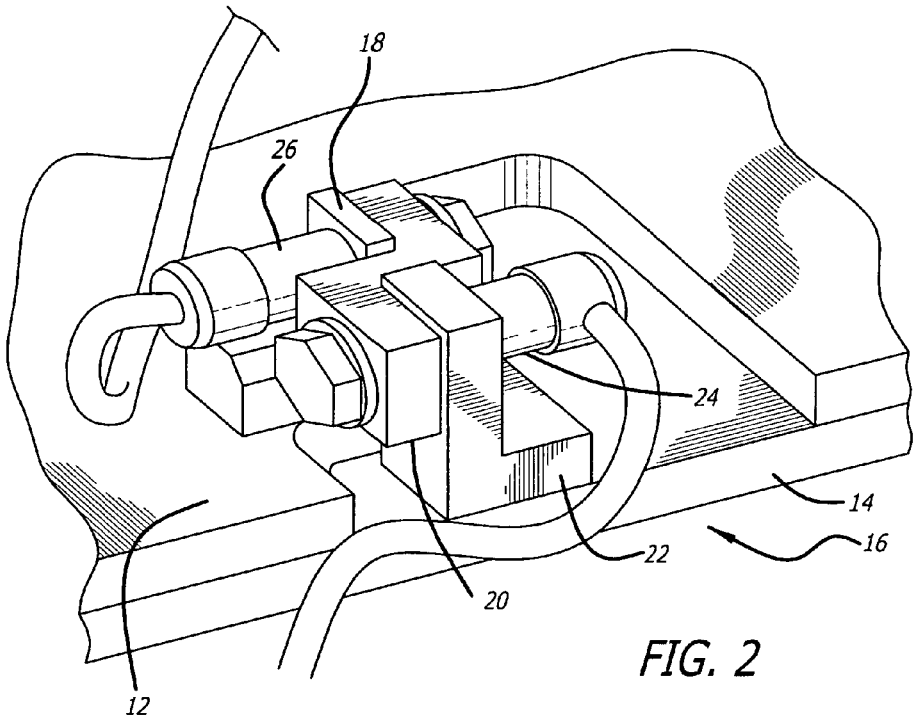
FIG. 2 is a perspective view of an illustrative implementation of the latch of the missile of FIG. 1*a* in accordance with the present teachings.

FIG. 2 is a perspective view of an illustrative implementation of the latch 16 of the missile of FIG. 1*a* in accordance with the present teachings. As shown in FIG. 2, the latch 16 includes a first bracket 18 secured to the missile body 12 on one side and to a second bracket 20 which serves as a common series attachment. The second bracket 20 is sandwiched between the first bracket 18 and a third bracket 22. The third bracket 22 is secured to the drag door 14. As shown in FIG. 2, a first pyrotechnic electrical explosive device (EED) 26 is used to secure the first bracket 18 to the second bracket 20. A second EED 24 secures the second bracket 20 to the third bracket 22. Each EED is an explosive nut or bolt, which is activated by an electrical signal from the range safety flight termination system not shown. In the preferred embodiment, the EEDs are nuts which engage bolts (not shown) that extend from the first and third brackets through holes provided in the serpentine second bracket 20.

Figure 3:
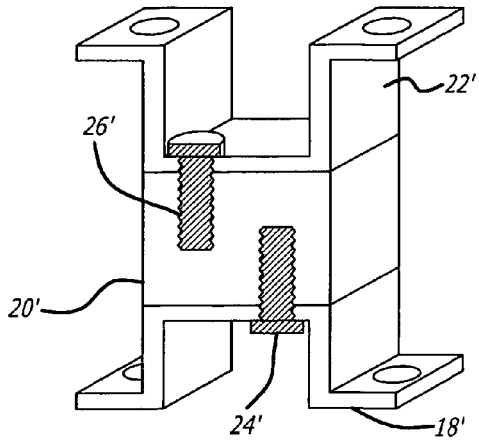
FIG. 3 is a simplified perspective view of an alternative arrangement of three brackets coupled in a series arrangement by two explosive bolts for the purpose of illustration.
Figure 4A:
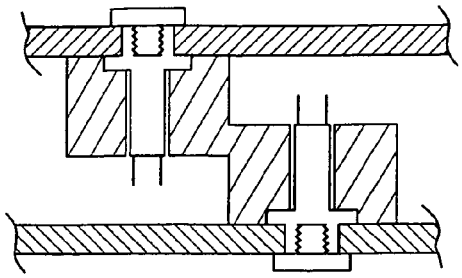
FIGS. 4(*a*)-(*h*) depict a variety of series coupling arrangements in accordance with the present teachings.
Figure 4B:
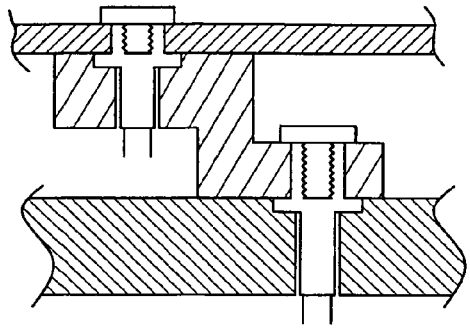
Figure 4C:
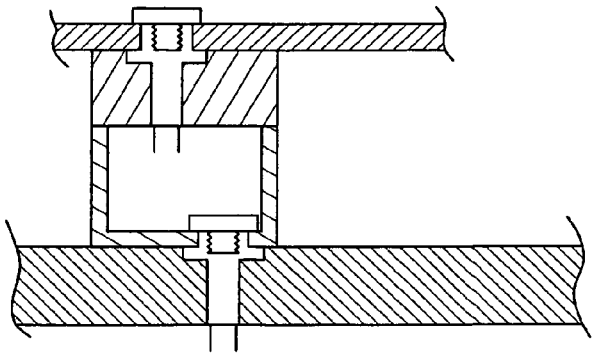
Figure 4D:
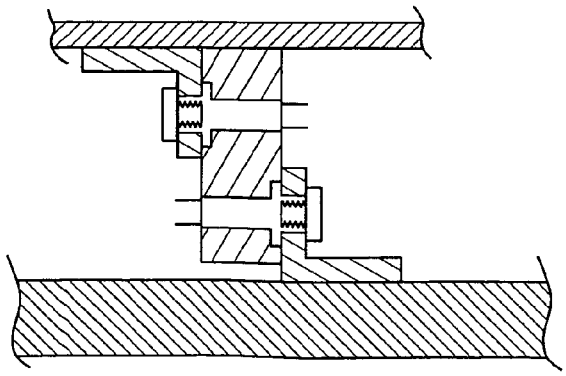

FIG. 3 is a simplified perspective view of an alternative arrangement of three brackets 18', 20' and 22' coupled in a series arrangement by two explosive bolts 24' and 26' for the purpose of illustration. As is evident from FIG. 3, a successful firing of either bolt 24' or 26' will yield a decoupling of the first bracket 18' from the third bracket 22' via the second bracket 20'. Additional illustrative coupling arrangements are shown in FIG. 4.

FIGS. 4(*a*)-(*h*) depict a variety of series coupling arrangements in accordance with the present teachings. FIGS. 4*e* and 4*f* are two views of the same embodiment. Likewise, FIGS. 4*g* and 4*h* are two views of the same embodiment. FIGS. 4*g* and 4*h* show an arrangement for capturing the severed ends of the explosive nuts after firing. In FIGS. 4*a*-4*c* the EEDs are normal to the door, thus all explosive energy is imparted to opening the door. Also, motion of the door is initially parallel to the axis of the EED which results in clean separation (separated surfaces of brackets move away from each other). In FIGS. 4*d* through 4*h*, the EEDs are parallel to the door, thus no explosive energy is imparted to opening the door. Also, initial motion of the door is perpendicular to the axis of the EED which results in possible friction due to separated surfaces of the brackets sliding over each other. The arrangement of FIG. 4(*d*) is closer to that of FIG. 2. In each case, the bolts and/or nuts are EEDs.

Those skilled in the art will appreciate the enhanced reliability afforded by the dual-redundant design of the latch of the present invention. This advantageous operation is illustrated below with respect to FIGS. 5-7.

Figure 5:
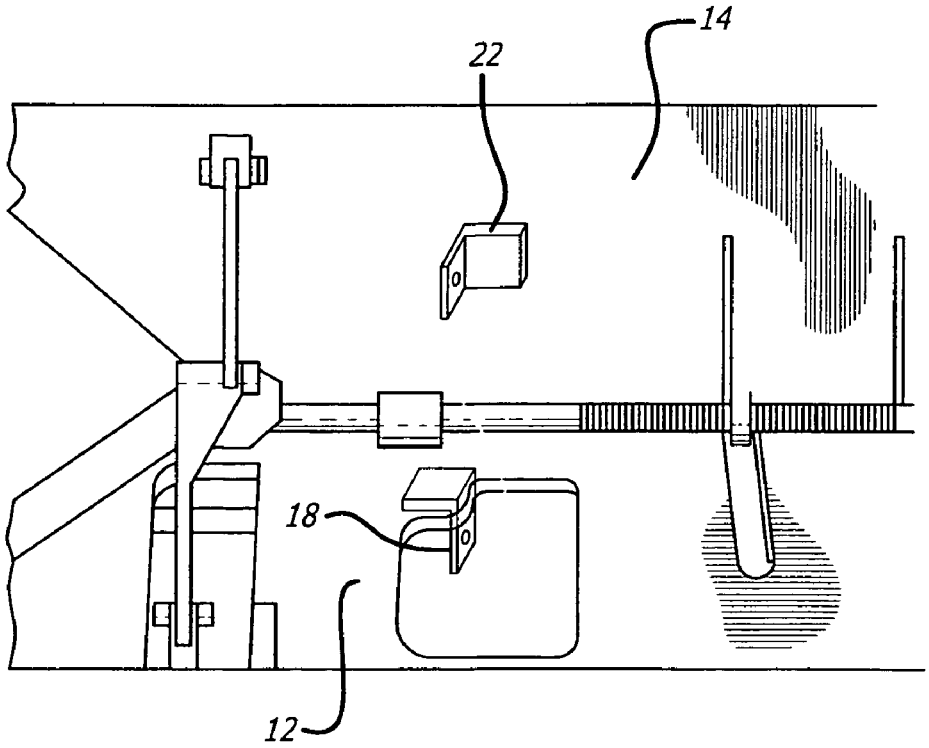
FIG. 5 is a front view of an illustrative implementation of a fully deployed drag door after successful firing of both EEDs in accordance with the present teachings.

FIG. 5 is a front view of an illustrative implementation of a fully deployed drag door after successful firing of both EEDs in accordance with the present teachings. In this case, both EEDs have fired successfully such that the latch 16 is split and the first bracket 18 remains affixed to the missile body 12 while the third bracket 22 remains fixed to the drag door 14.

FIG. 6 is a front view of an illustrative implementation of a fully deployed drag door after a mis-firing of one of the EEDs such that the second bracket 20 remains with the drag door 14.

FIG. 7 is a front view of an illustrative implementation of a fully deployed drag door after a mis-firing of one of the EEDs such that the second bracket 20 remains with the missile body 12.

In the preferred embodiment, the axis of each of the EEDs is canted approximately 20 degrees with respect to the door in the closed position. This has the advantage of reducing the explosive energy imparted to opening the door, and reduces friction and possible jam by having the separated surfaces of the door pull away from each other.

Thus, the present invention has been described herein with reference to a particular embodiment for a particular application. Those having ordinary skill in the art and access to the present teachings will recognize additional modifications applications and embodiments within the scope thereof. For the example, the invention is not limited to the use of electrical explosive devices. Any releasable mechanical arrangement may be used in accordance with the present teachings.

It is therefore intended by the appended claims to cover any and all such applications, modifications and embodiments within the scope of the present invention.

Accordingly,

What is claimed is:

1. A dual-redundant electro-explosive device latch mechanism comprising:

first, second and third brackets in a series arrangement;

a first electrical explosive device coupling only the first and second brackets; and a second electrical explosive device coupling only the second and third brackets, wherein the first bracket is coupled to a vehicle body and the third bracket is coupled to a drag door, and wherein failure of either but not both electrically explosive devices to activate is effective to decouple at least one of the first or third bracket from the second bracket to provide separation of the drag door from the body at the latch mechanism.

2. The dual-redundant electro-explosive device latch mechanism of claim 1 wherein when either but not both of the explosive devices fails to activate, the first or third bracket is configured to separate from the second bracket to unlatch the drag door to provide fail-safe operation.

3. The dual-redundant electro-explosive device latch mechanism of claim 2 wherein the first electrical explosive device is coupled to the vehicle body on a first end of the device and to a common series attachment on another end thereof.

4. The dual-redundant electro-explosive device latch mechanism of claim 3 wherein the second electrical explosive device is connected to the common series attachment on a first end and to the drag door on a second end thereof.

5. The dual-redundant electro-explosive device latch mechanism of claim 2 wherein the vehicle is a missile, and wherein unlatching of the drag door is configured to disrupt flight of the missile.

6. The dual-redundant electro-explosive device latch mechanism of claim 2 wherein the vehicle is an unmanned aircraft, and wherein unlatching of the drag door is configured to disrupt flight of the unmanned aircraft.

7. The dual-redundant electro-explosive device latch mechanism of claim 2 wherein the vehicle is a torpedo, and wherein unlatching of the drag door is configured to disrupt motion of the torpedo.

8. The dual-redundant electro-explosive device latch mechanism of claim 1 further including means for activating the electrical explosive devices simultaneously.

9. A vehicle comprising:

a body; and at least one drag door attached to the body on one end of the drag door and secured to the body on another end of the door with a latch, the latch comprising:

first, second and third brackets in a series arrangement;

a first electrical explosive device coupling only the first and second brackets; and a second electrical explosive device coupling only the second and third brackets, wherein the first bracket is coupled to the body and the third bracket is coupled to the drag door, and wherein failure of either but not both electrically explosive devices to activate is effective to decouple at least one of the first or third bracket from the second bracket to provide separation of the drag door from the body at the latch mechanism.

10. The vehicle of claim 9 wherein when either but not both of the explosive devices fails to activate, the first or third bracket is configured to separate from the second bracket to unlatch the drag door to provide fail-safe operation.

11. The vehicle of claim 10 wherein the first electrical explosive device is coupled to the vehicle body on a first end of the device and to a common series attachment on another end thereof, and wherein the second electrical explosive device is connected to the common series attachment on a first end and to the drag door on a second end thereof.

12. The vehicle of claim 9 wherein the vehicle is a missile, and wherein unlatching of the drag door is configured to disrupt flight of the missile.

13. The vehicle of claim 9 wherein the vehicle is a torpedo, and wherein unlatching of the drag door is configured to disrupt motion of the torpedo.

14. The vehicle of claim 9 wherein the vehicle is an unmanned aircraft, and wherein unlatching of the drag door is configured to disrupt flight of the unmanned aircraft.

15. The vehicle of claim 9 further including means for activating the electrical explosive devices simultaneously.

16. A dual-redundant latch comprising:

a first bracket coupled to a first surface;

a second bracket; and a third bracket coupled to a second surface, wherein the first, second and third brackets are in a series arrangement, wherein the first and second brackets are configured to be coupled by a first release mechanism and the second and third brackets are configured to be coupled by a second release mechanism, and wherein failure of either but not both electrically explosive devices to activate is effective to decouple at least one of the first or third brackets from the second bracket.

17. The dual-redundant latch of claim 16 wherein the release mechanisms are electrically explosive devices, and wherein when either but not both of the explosive devices fails to active, the first or third bracket is configured to separate from the second bracket to unlatch the latch to provide fail-safe operation.

18. The dual-redundant latch of claim 17 further including an arrangement for activating the explosive devices simultaneously.

19. A method for deploying a drag door comprising:

securing the drag door to a vehicle body with a dual-redundant electro-explosive device latch mechanism comprising first and second electrical explosive devices; and simultaneously activating the electrical explosive devices, wherein the latch mechanism comprises first, second and third brackets are in a series arrangement, wherein the first electrically explosive device couples the first and second brackets, wherein the second electrically explosive device couples the second and third brackets, and wherein failure of either but not both electrically explosive devices to activate is effective to decouple at least one of the first or third bracket from the second bracket to provide separation of the drag door from the body at the latch mechanism.

20. The method of claim 19 wherein when either but not both of the explosive devices fail to operate, the first or third bracket is configured to separate from the second bracket to unlatch the drag door to provide fail-safe operation.

21. The method of claim 20 wherein the first electrical explosive device is coupled to the vehicle body on a first end of the device and to a common series attachment on another end thereof.

22. The method of claim 21 wherein the second electrical explosive device is connected to the common series attachment on a first end and to the drag door on a second end thereof.

23. The method of claim 20 wherein the vehicle is a missile, and wherein unlatching of the drag door is configured to disrupt flight of the missile.

24. The method of claim 20 wherein the vehicle is a torpedo, and wherein unlatching of the drag door is configured to disrupt motion of the torpedo.

25. The method of claim 20 wherein the vehicle is an unmanned aircraft, and wherein unlatching of the drag door is configured to disrupt flight of the unmanned aircraft.

* * * * *

UNITED STATES PATENT AND TRADEMARK OFFICE

CERTIFICATE OF CORRECTION

PATENT NO. : 7,775,147 B2
APPLICATION NO. : 12/077157
DATED : August 17, 2010
INVENTOR(S) : Daniel M. Crawford et al.

It is certified that error appears in the above-identified patent and that said Letters Patent is hereby corrected as shown below:

In column 1, below "Title", line 3, insert

-- STATEMENT OF GOVERNMENT RIGHTS
This invention was made with United States Government support under Contract Number F08635-03-C-0002 with the Department of the Air Force. The United States Government has certain rights in this invention. --.

Signed and Sealed this

Twenty-third Day of November, 2010

David J. Kappos

David J. Kappos
*Director of the United States Patent and Trademark Office*